United States Patent [19]

Parsons

[11] Patent Number: 4,752,072

[45] Date of Patent: Jun. 21, 1988

[54] TELESCOPING SELF-DEFENSE KEYCHAIN

[76] Inventor: Kevin L. Parsons, 16 Wagon Wheel Dr., Appleton, Wis. 54915

[21] Appl. No.: 944,731

[22] Filed: Dec. 22, 1986

[51] Int. Cl.[4] ..... F41B 15/02

[52] U.S. Cl. ..... 273/84 R; 70/456 R

[58] Field of Search ..... 273/84 R, 84 A, 84 ES; 70/456 R, 456 B, 457, 458; D3/61, 62

[56] References Cited

U.S. PATENT DOCUMENTS

| | | | |
|---|---|---|---|
| 1,909,932 | 5/1933 | Digel | 273/84 R |
| 4,460,174 | 7/1984 | Perry | 273/84 |
| 4,475,367 | 10/1984 | Raitto | 70/456 |
| 4,506,889 | 3/1985 | Lewis | 273/84 |

OTHER PUBLICATIONS

Kubotan Keychain, Takyuk; Kubota, Jan. 1985, p. 9.

Action Kubotan Key Chain, Takayaki Kubota, 1982, pp. 2–7.

The Cobraton System, Joseph J. Truncale, Ph.D. & Ben O. Gagliardi, 1984, pp. 1–5.

The Persuader Baton, Monadnock Lifetime Products, Inc., Aug. 1982, p. 1.

Use of the Persuader Key Ring, Arthur N. Sapp and Thomas A. Gentry, Dec. 1985, pp. 19–24.

Captain Smith's Pow-R Stik, Captain James A. Smith, 1981, pp. 3–11.

*Primary Examiner*—Richard C. Pinkham

*Assistant Examiner*—William E. Stoll

*Attorney, Agent, or Firm*—Quarles & Brady

[57] ABSTRACT

A telescoping self-defense keychain includes a keyring attached on a swivel for tethering one or more keys. The keychain may also be used for self-defense or by police to control a suspect during arrest. The keychain has a telescoping member which may be extended to increase the overall length of the keychain to provide more effective use as a weapon. The telescoping member is held in the extended position by a flared end on the telescoping member which wedges into a swaged end of the handle. A leaf spring engages the flared end of the telescoping member to retain it in a retracted position.

5 Claims, 1 Drawing Sheet

TELESCOPING SELF-DEFENSE KEYCHAIN

BACKGROUND OF THE INVENTION

The field of the invention is passive self-defense weapons, and more particularly, self-defense keychains. Self-defense keychains consist of a metal or hard plastic handle with a ring on one end for the attachment of keys. Such keychains have dual uses; as an ordinary keychain to conveniently tether one or more keys, and as a self-defense weapon.

There are five basic modes in which self-defense keychains can be used as a weapon. First, the handle may be grasped to strike a swinging blow with the keyring end. This mode is most effective when a bundle of keys are attached to the keyring. Secondly, the keys attached to the keyring may be grasped to strike a swinging blow with the handle end. Some types of self-defense keychains have double keyrings attached in series on one end of the handle to afford greater flexibility for swinging blow. Thirdly, the handle may be grasped to strike either a forehand or backhand jabbing blow with the butt or tip of the handle. A pressure grip may be applied by placing the side of the handle across a sensitive area, usually the wrist, of an adversary, and squeezed to inflict pain compliance. And finally, the butt or tip end of the handle may be used for pain compliance, for example when applied in the pectoral region.

Self-defense keychains are used by police as an aid in controlling subjects during arrest and by civilians to defend against physical attack. Because this self-defense instrument also serves as a keychain, it is usually carried on the person of its owner and is therefore readily available. Other types of weapons may not be readily available when needed.

The handles of prior self-defense keychains are about five to six inches long in order to be a convenient size. Thus, the handle of such a prior self-defense keychain in only slightly longer than the users hand when grasping the handle, which limits the range over which it can be used for jabbing and swinging blows. Also, it is not always possible or desirable to have a sufficiently large bundle of keys attached to the keyring to be effective either as a mace end or as a grip for swinging the handle.

SUMMARY OF THE INVENTION

A telescoping self-defense keychain according to this invention includes a handle with a keyring attached on one end. One or more keys may be attached to the keyring. A telescoping member is slidably disposed within the handle. In a retracted position, as is the normal case, the telescoping self-defense keychain functions as both a keychain and as a self-defense weapon for pressure holds or for striking blows at close range. The telescoping member may also be extended and locked in an extended position to increase the overall length of the keychain.

An object of this invention is to provide a self-defense keychain which has a shorter length for convenient use as a keychain and can be extended to a longer length thereby increasing its effectiveness as a weapon for striking blows at a greater distance and without the necessity of relying on the attached keys as the striking object.

Another object of this invention is to provide a locking mechanism to lock the telescoping member in the extended position which is mechanically simple and reliable. The end of the telescoping member inside the handle is flared out to mate with a swaged end of the handle which receives it. When extended, the flared end of the telescoping member wedges into the swaged end of the handle with sufficient force to remain locked during any blow to an adversary.

Yet another object of the invention is to provide a keychain in which the telescoping member is retained in the retracted position. A leaf spring on the inside of the handle engages the flared end of the telescoping member to provide the required retention.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
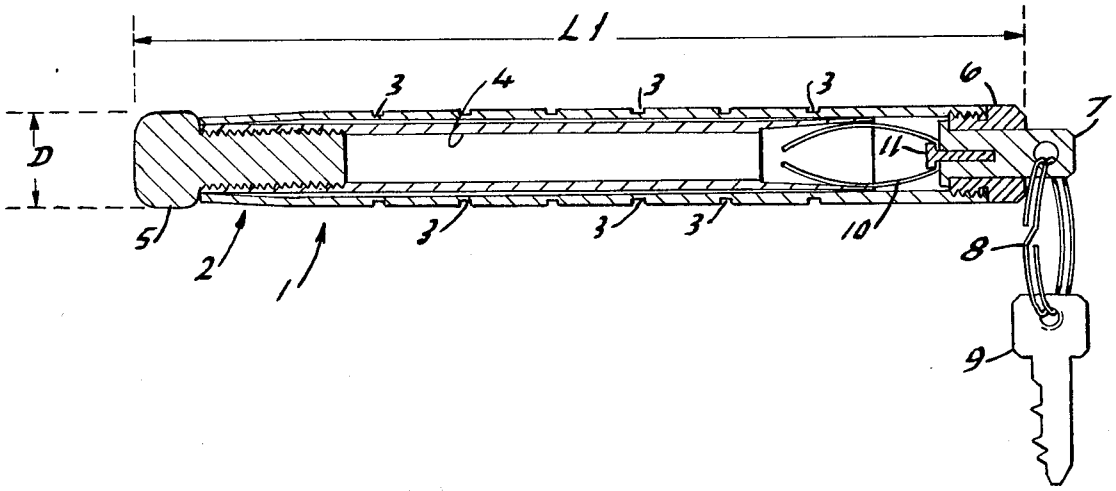
FIG. 1 is a sectional plan view of a telescoping self-defense keychain of the present invention in the retracted position.

Referring to FIG. 1, a telescoping self-defense keychain 1 includes a handle 2 formed from a hollow tube of 16 gauge aluminum with an outside diameter D of approximately $\frac{5}{8}$ inches. The handle 2 includes a series of axial grooves 3 spaced apart approximately $\frac{1}{2}$ inch along the length of the handle to prevent slipping during use. A telescoping member 4 is disposed within the handle 2 One end of the telescoping member 4 is threaded to receive a tip 5. The tip 5 is made of solid aluminum with rounded corners. The rounded corners allow infliction of pain without serious or permanent injury. In the retracted position of FIG. 1, the tip 5 abuts with the end of the handle 2. It should be apparent to one skilled in the art that other materials may be used for fabricating the parts of this invention such as, for example, steel or a hard plastic.

The outside diameter of the telescoping member 4 is approximately 1/16 inch smaller than the inside diameter of the handle 2. The end of the handle 2 which receives the telescoping member 4 is swaged down to a diameter just slightly larger than the outside diameter of the telescoping member 4, about 0.005 inches larger for this embodiment. The end of the telescoping member 4 opposite the tip 5 is flared out to a diameter just slightly smaller than the inside diameter of the handle 2, again about 0.005 inches smaller. The telescoping member 4 is thus free to travel longitudinally inside the handle 2.

The end of the handle 2 opposite the tip 5 is threaded to receive an end cap 6. The end cap 6 is bored through with a hole to receive a key ring swivel 7. The swivel 7 has a hole in the portion of the swivel 7 that extends outside of the end cap 6. A key ring 8 is attached through the hole in the swivel 7 and through one or more keys 9. The swivel 7 has a lip on the portion inside the end cap 6 which retains the swivel 7 in the end cap 6. A leaf spring 10 is attached to the end of the swivel 7 inside the handle 2 with a rivet 11. The spring extends into the interior of the handle 2 and is long enough to make contact with the flared end of the telescoping member 4 in the retracted position and thus provides a frictional force for retaining the telescoping member 4 in the retracted position. Many other types of retaining mechanisms may be used in this invention for holding the telescoping member 4 in the retracted position. Examples of other types of retaining mechanisms include magnets, o-rings, spring loaded detents, and lever mechanisms.

Figure 2:
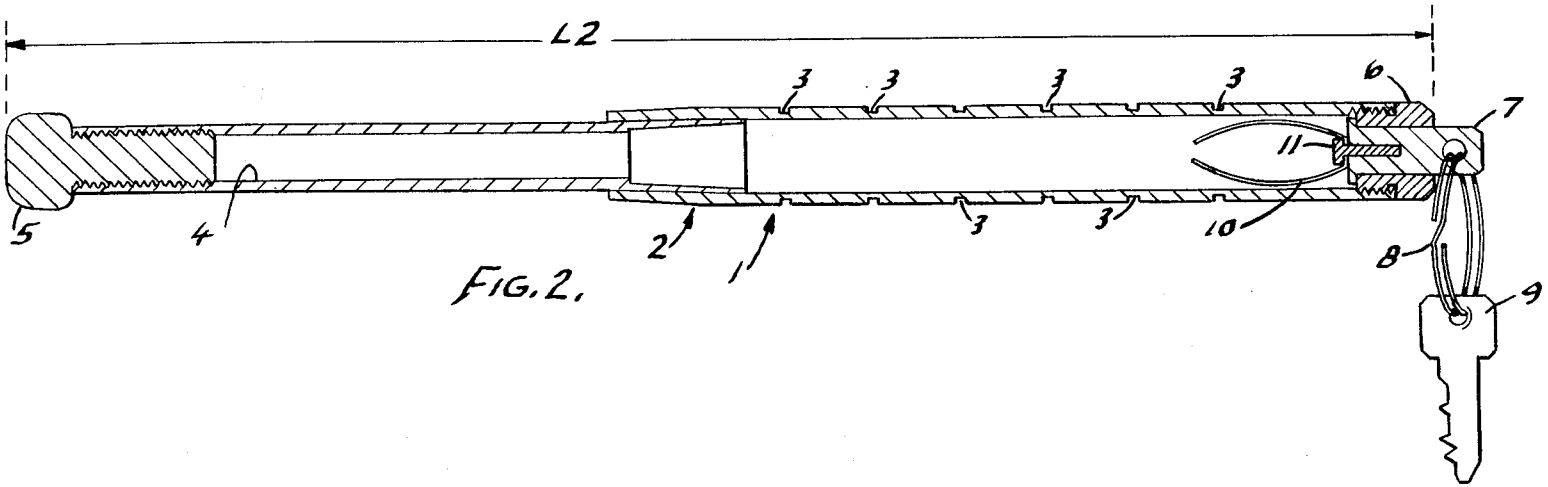
FIG. 2 is a sectional plan view of the telescoping self-defense keychain of FIG. 1 in the extended position.

Referring to FIG. 2, the telescoping member 4 is free to slide inside the handle 2 until the flared end of the telescoping member 4 contacts with the swaged end of the handle 2. The tapers of the swage on the handle 2 and the flare on the telescoping member 4 are approximately the same, so that when contact is made therebetween the flared end of the telescoping member 4 is securely wedged into the swaged end of the handle 2. The wedge so formed is sufficiently strong that it will not be broken free by a jabbing blow or by axial pressure on a subject. The wedge is so strong that in order to retract the telescoping member it is necessary to make a sharp axial strike of the tip 5 against a hard, solid surface, such as, for example, a concrete wall or pavement. Other types of mechanisms could be used to lock the telescoping member 4 in the extended position. For example, a twist lock mechanism (not shown) or a spring loaded switch-blade type mechanism (not shown) could be used for this invention. However, the wedge mechanism of this embodiment is preferred for its mechanical simplicity, reliability and simple operation, which is highly advantageous since the keychain 1 is used as a weapon only in highly stressful situations and may be needed quickly, for example, in case of surprise attack. The telescoping member 4 may be extended by a quick downward swing of the handle 2. In doing so, the centrifugal force on the telescoping member 4 is enough to overcome the friction of the retaining spring 11 and the telescoping member 4 snaps and locks into the extended position of FIG. 2.

The added length of the keychain 1 when extended is a principal advantage of this invention over non-telescoping keychains. In the retracted position of FIG. 1, the keychain 1 has a length L1 of about 5½ inches. This length is typical for prior self-defense keychains. However, in the extended position of FIG. 2, the telescoping self-defense keychain 1 has a length of L2 of approximately 8¾ inches. The extra length afforded by this invention could make the difference between a hit or a miss on a swinging blow, especially when a smaller person is under attack by a larger person and is being held at arms length. The same holds true for jabbing blows, where the extra length may be needed to reach an adversary. Also, when extended, the keychain 1 of this invention can be used effectively to deliver a swinging blow with the tip 5 while holding the handle 2. Therefore, the keys 9 do not need to be used as a grip and a large bundle of keys is not necessary.

The discrete parts which comprise the keychain 1 may be manufactured separately and assembled. The telescoping member 4 may be inserted into the handle with the end cap 6 removed. Then the tip 5 is threaded into the telescoping member 4. The end cap 6 is then threaded into the handle 2 to complete the assembly. The swivel 7 is free to rotate in the end cap 6 as a convenience when manipulating the keys 9.

I claim:

1. A self-defense keychain comprising:

a handle member having a cavity in the interior with an opening on one end of the handle exposing the cavity;

a keyring attached to one end of the handle;

a telescoping member disposed in the cavity of the handle and having a tip end which extends through the opening in the handle, the telescoping member being movable between a retracted position and an extended position;

locking means for locking the telescoping member in the extended position, the locking means comprising a flared end on the telescoping member which wedges into a swaged end on the handle member; and retaining means for holding the telescoping member in the retracted position.

2. The self-defense keychain as recited in claim 1 in which the retaining means comprises a leaf spring which engages the flared end of the telescoping member with sufficient friction to hold the telescoping member in the retracted position.

3. The self-defense keychain as recited in claim 2 in which the handle includes a swivel with a hole for attaching the keyring.

4. The self-defense keychain as recited in claim 3 in which the handle includes an end cap which is threaded into one end of the handle, the end cap containing an axial hole through which the swivel passes, the swivel being thereby retained by the end cap.

5. The self-defense keychain as recited in claim 4 in which the tip end of the telescoping member is a separate piece which is threaded into the telescoping member and is removable.

* * * * *